US006125942A

United States Patent [19]

Kaufman et al.

[11] Patent Number: 6,125,942

[45] Date of Patent: Oct. 3, 2000

[54] AIRCRAFT-BASED FIRE-FIGHTING BUCKET

[75] Inventors: Andrew E. Kaufman; William J. Usab, Jr., both of West Windsor, N.J.

[73] Assignee: Continuum Dynamics, Inc., Ewing, N.J.

[21] Appl. No.: 09/267,878

[22] Filed: Mar. 11, 1999

Related U.S. Application Data

[60] Provisional application No. 60/077,931, Mar. 13, 1998.

[51] Int. Cl.[7] ..... A62C 25/00

[52] U.S. Cl. ..... 169/53; 239/171; 244/136; 222/548

[58] Field of Search ..... 169/53, 46, 56, 169/60, 61; 244/136, 137.4, 142; 239/171, 562, 581.1; 222/548, 485, 448

[56] References Cited

U.S. PATENT DOCUMENTS

| | | | |
|---|---|---|---|
| 3,688,952 | 9/1972 | Barlow et al. | 239/171 |
| 3,754,601 | 8/1973 | Linkewich | 169/44 |
| 3,828,857 | 8/1974 | Mason | 169/53 |
| 4,195,693 | 4/1980 | Busch et al. | 239/171 |
| 4,576,237 | 3/1986 | Arney | 169/53 |
| 4,601,345 | 7/1986 | Mahrt | 169/53 |
| 4,671,472 | 6/1987 | Hawkshaw | 169/53 |
| 4,785,976 | 11/1988 | Bennie et al. | 239/581.1 |
| 5,560,429 | 10/1996 | Needham | 169/53 |

*Primary Examiner*—Andres Kashnikow
*Assistant Examiner*—Dinh Q. Nguyen
*Attorney, Agent, or Firm*—David M. Quinlan, P.C.

[57] ABSTRACT

A fire fighting system uses a bucket suspended from a helicopter to deposit fire retardant onto a fire from an opening in the bottom of the bucket. The bucket has a predetermined configuration and a valve for controlling the area of an opening through which the retardant is deposited when the bucket is suspended from the helicopter. A suitable mechanism, such as an electrically driven valve actuator, varies the area of the opening to deposit the retardant at a volume flow rate as a desired function of time while the helicopter flies along a drop line. The mechanism varies the area of the opening in accordance with a schedule determined before discharge is begun according to the configuration of the bucket, the flow characteristics of the opening as the valve changes the area thereof, and the initial amount of the retardant material in the bucket. As a result, the desired volume flow rate profile can be achieved without the use of expensive and fragile electronic circuitry and sensors that monitor the height of the retardant in the bucket during the deposition.

33 Claims, 6 Drawing Sheets

AIRCRAFT-BASED FIRE-FIGHTING BUCKET

CROSS-REFERENCE TO RELATED APPLICATIONS

This application claims the benefit of U.S. provisional application No. 60/077,931, filed Mar. 13, 1998.

ACKNOWLEDGEMENT OF GOVERNMENT SUPPORT

This invention is based upon work supported by the Cooperative State Research, Education, and Extension Service, U.S. Department of Agriculture, under Agreement No. 96-33610-2598.

BACKGROUND OF THE INVENTION

1. Field of the Invention

The present invention relates to a fire-fighting system that drops flowable materials from a bucket carried by an aircraft, and more particularly, to such systems using simplified open-loop control to dispense such materials at a desired volume flow rate.

2. Description of Related Art

Large fires are often fought using aircraft to drop fire retardants, which can be specially formulated liquids, granular solid materials, or even plain water, either directly on the fire or at nearby locations to create a fire break. A very effective approach to this kind of fire fighting uses a large bucket suspended from a helicopter.

Helicopters are generally used for sustained fire fighting operations because they are more versatile than fixed wing aircraft. Since a helicopter does not require a landing strip, the bucket can be filled, without landing the helicopter, at a nearby body of water or at a temporary staging area set up to maintain a supply of fire retardant material close to the fire. This reduces the amount of time required between retardant drops, which likewise reduces the time required to extinguish the fire.

Buckets typically range in capacity from 90 to 3000 gallons or more. Many allow for partial filling to accommodate the lifting capacity of different helicopters with which they may be used. Known buckets come in a variety of configurations, a common one being a conic section with a tapered bottom. They may be made of a rigid material (often fiberglass to save weight) with a valved opening in the bottom, or they can be made of fabric mounted on a frame. They are slung from 25 to 200 feet under the helicopter, which hovers as the bucket is filled from either a nearby body of water or a tank filled with a flowable fire retardant material. The bucket or aircraft may have an on-board pump to reduce the amount of filling time. When the bucket is full, the helicopter proceeds to the drop zone where the fire retardant is emptied through an opening in the bucket, usually as the helicopter flies along a drop line.

While this is a highly effective manner of delivering large quantities of retardant to a fire burning over a large area, prior art implementations of this approach have numerous drawbacks.

For one thing, the fire retardant material must be deposited on the ground at a specific minimum concentration depending on the type of fire. Studies, such as Deeming, J. E., "The National Fire Danger Rating System—1978," *General Technical Report INT*-39, USDA Forest Service, Intermountain Forest and Range Experiment Station, Ogden Utah (1978), have set forth the concentrations of fire retardant needed on fires involving different types of vegetation.

Any concentration (volume flow rate) of retardant other than the optimum wastes valuable resources. A concentration that is too high obviously wastes retardant, as does a concentration that is too low. However, a more severe consequence is that an excessive retardant concentration reduces the area that can be covered by the fixed amount of retardant in the bucket. That increases the time required to extinguish the fire because more trips will have to be made to cover the area that is burning. An insufficient concentration over some of the drop area has the same effect because additional depositions will have to be made at locations that did not receive enough retardant. Not only does increasing the time to extinguish the fire cause additional loss of whatever is in the path of the fire, it also requires additional aircraft operating time. This is especially critical considering that fire-fighting aircraft and operating crews are often paid thousands of dollars per hour. If the additional time requires the use of additional helicopter crews, the cost increases further still.

The goal, then, is delivery of no more or less than the desired coverage level along a particular drop line. Even better would be the ability to control drop line length.

The volume rate of flow of the material from the bucket affects the actual deposition rate on the ground more than any other factor. The most basic manner of emptying the bucket carrying the retardant simply opens a valve as quickly as possible when the helicopter approaches the drop line, thus allowing the material to flow uncontrolled out of the bucket. There are many different types of valves, both electrically and hydraulically driven, known to be suitable to this purpose. A fabric bucket can use flaps that are sealed by the pressure head of the retardant and opened by pulling a rope attached to the flaps. In any case, simply opening the bucket and letting the fire retardant material empty out results in a varying deposition rate as the bucket empties.

U.S. Pat. No. 5,279,481, U.S. Pat. No. 5,320,185 and U.S. Pat. No. 5,451,016 address the problem of how to achieve a constant volume flow rate of retardant from a bucket.

The approach in these patents monitors the liquid level in the bucket throughout deposition and uses closed-loop control circuitry to match the volume flow rate out of the bucket to the desired rate. These systems are very effective in providing the necessary control, but the precision they afford is simply not needed in this operating environment. That is, considering that the volume flow rates are typically hundreds of gallons per second, and that the retardant is being dropped from a height of a hundred or so feet, complex closed-loop control systems are not very cost effective because the degree of control they provide is well in excess of what is necessary to provide effective fire fighting capability.

There are also other problems with such an approach. Monitoring the fluid level or the volume of the retardant as the bucket empties is straightforward in theory, but in reality the bucket is buffeted by external forces that cause the retardant to slosh around and make it difficult to obtain an accurate reading of the amount of retardant left in the bucket at any particular time. U.S. Pat. No. 5,320,185 and U.S. Pat. No. 5,451,016 disclose a way of electronically compensating for this effect, but that simply increases the complexity of the control system. In addition, these systems require electronic control circuitry to be in constant communication with sensors in the bucket monitoring the retardant level. The inevitable rough handling of the bucket in this operating environment will contribute to breakdowns of such a system, either in the sensors, the control circuitry, or the cables over which they communicate. That results both in lost operating time for the bucket and increased cost attributable to expensive replacement parts.

Unfortunately, up to now there has been no other known manner of providing the desired degree of control over the retardant volume flow rate.

SUMMARY OF THE INVENTION

It is an object of the present invention to control the deposition of a material from an aircraft that overcomes the above problems in the prior art.

It is another object of the invention to provide a bucket for depositing a flowable material, the bucket comprising means for attaching the bucket to an aircraft, an opening in the bucket for discharging the material, and a flow controller for varying the characteristics of the flow through the opening to discharge the material at a volume flow rate as a desired function of time while the aircraft flies over a drop zone, wherein said flow controller varies the characteristics of the flow through the opening as a function of time determined prior to initiation of discharge.

It is still another object of the invention to provide a bucket having a predetermined configuration for depositing a flowable material, the bucket comprising means for attaching the bucket to an aircraft, an opening in the bucket for discharging the material, and a flow controller for varying the characteristics of the flow through the opening to discharge the material at a volume flow rate as a desired function of time while the aircraft flies over a drop zone, wherein the flow controller varies the flow characteristics through the opening as a set function of time determined prior to initiation of discharge in accordance with the configuration of the bucket and the amount of the material in the bucket before discharge begins.

In its broadest method aspects, it is an object of the invention to provide a method for depositing a flowable material at a volume flow rate as a desired function of time, the method comprising the steps of providing a bucket having an opening for discharging the material, attaching the bucket to an aircraft with the opening disposed proximate to the bottom of the bucket, filling the bucket with an amount of the material, flying over a drop zone with the bucket attached to the aircraft, and depositing the material on the drop zone at the desired volume flow rate by controlling the characteristics of the flow through the opening as a function of time determined prior to initiation of discharge.

In more specific aspects, it is an object of the invention to control the characteristics of the flow through the opening by controlling a resistance of the flow through the opening, a configuration of the flow through the opening, or the area of the opening.

The invention is particularly applicable to depositing a fire retardant material at an optimum ground coverage rate throughout the drop zone.

BRIEF DESCRIPTION OF THE DRAWINGS

The objects of the invention will be better understood from the detailed description of its preferred embodiments which follows below, when taken in conjunction with the accompanying drawings, in which like numerals refer to like features throughout. The following is a brief identification of the drawing figures used in the accompanying detailed description.

DETAILED DESCRIPTION OF THE PREFERRED EMBODIMENTS

Figure 1:
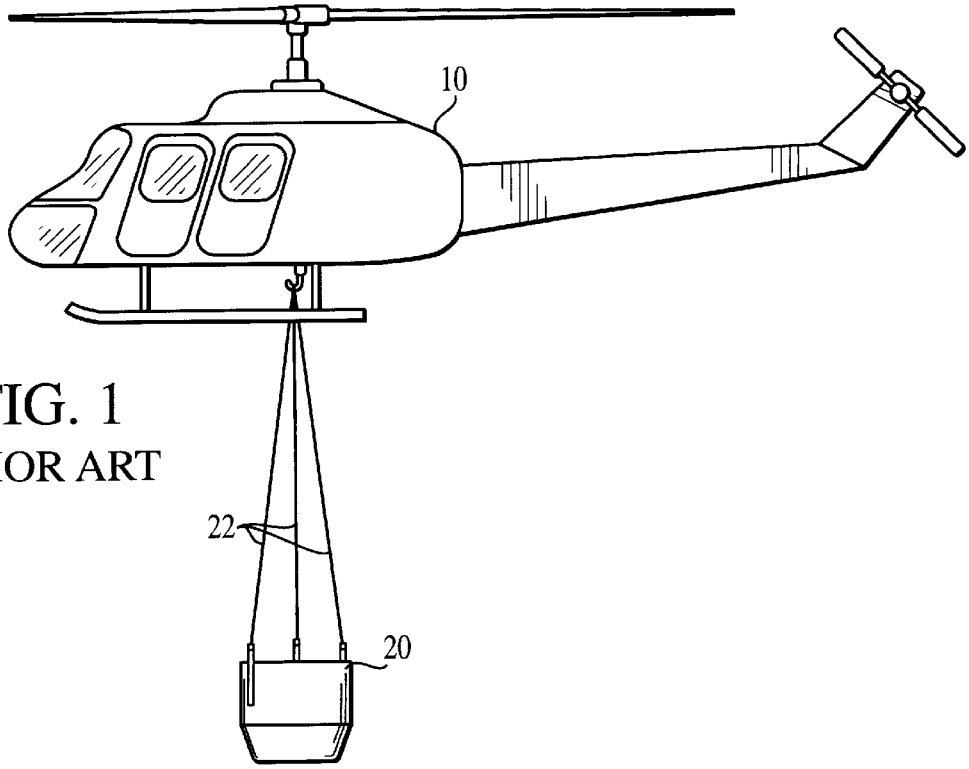
FIG. 1 PRIOR ART
FIG. 1 shows a helicopter having suspended therefrom a fire retardant bucket suitable for use with the present invention.

FIG. 1 illustrates a helicopter 10 having a bucket 20 suspended from it by cables 22. A particularly advantageous application of the present invention is in fire fighting to ensure that the proper concentration of fire retardant in the bucket 20 is deposited during the flight of the helicopter. Other applications are possible within the scope of the invention. For example, U.S. Pat. No. 4,936,389 discusses the use of an aircraft-mounted delivery system used to deposit seeds over extensive areas. For that reason, references herein to "liquids" are intended to include any material (such as granulated particles or seeds) that have flow characteristics similar to liquids, since the present invention can be used with any such material.

The present invention controls the volume flow rate out of the bucket in accordance with a predetermined schedule based on the bucket geometry, the flow characteristics of an opening through which the bucket contents are discharged, and the initial height of the bucket's contents, all of which are independent of the instantaneous height or volume of the contents of the bucket as it empties. This "open-loop" control approach embodied by the present invention provides extremely accurate and highly controllable ground coverage, but does not rely on parameters that must be measured as the bucket empties, and thus eliminates the need for the complex, fragile and expensive closed-loop control systems used in the prior art.

Figure 2:
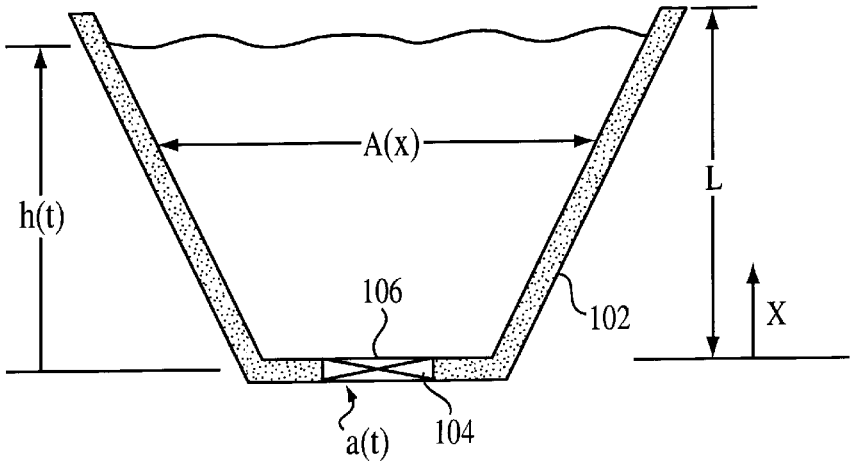
FIG. 2 is a schematic cross-section of a bucket used to illustrate the principles underlying the present invention.

FIG. 2 is a cross-sectional view of a schematic version of a generic bucket that will be used to explain the principles underlying the present invention. The bucket includes a body 102 and an opening 104 in the bottom of the bucket. The cross-sectional area "a" of the opening is controlled by a valve 106. The valve 106 is controlled in a conventional manner, such as by a submersible DC motor within the bucket 20 that drives a ball screw to move the valve 106 to the desired position. Embodiments of the valve 106 particularly adapted to implement the present invention are described in detail later.

The vertical direction is defined as the "x" axis for purposes of describing the principles of operation of the invention. "Vertical" as used herein means the opposite that in which gravity acts when the bucket is in its operating position, for example, implemented as the bucket 20 suspended from the helicopter 10. The opening 104 is shown in the bottom of the bucket, since such placement will generally ensure that the bucket is completely emptied when the valve is opened. The invention is not limited to that location of the opening. (Terms such as "vertical," "up," "bottom," and the like are used to assist in describing embodiments of the invention; their use should not be taken to limit the invention to being used in any particular orientation.)

The cross-sectional area A of the bucket in a plane normal to the "x" axis will vary in accordance with a predetermined relation denoted as A(x). That is, for any given bucket, the cross-sectional area can be expressed as a function of the vertical distance "x" from the opening 104. The parameter L is the total vertical distance from the opening 104 to the top of the bucket 20.

Other parameters used in the equations that define the principles underlying the invention are the height "h" of the retardant in the bucket, as measured from the bottom of the bucket. The value of "h" will vary as the bucket empties, and therefore can be expressed as h(t), a function of the time "t" from the instant when the valve reaches its initial position to begin emptying the bucket. In accordance with the present invention, the valve 106 is used to vary the area "a" through which the retardant flows. Accordingly, the area "a" of the opening 104 and the flow velocity "u" of the retardant through the opening can be expressed as a function of the time "t" from the beginning of deposition, that is, a(t) and u(t). In operation, the valve 106 is quickly opened to an initial value at the initiation of a retardant drop, which is defined as t=0. It should be understood that for purposes of this exposition of the physics underlying the invention, "a" denotes the geometric area through which the bucket contents flow, not the effective flow area through the valve 106.

Since the flow in the bucket can be assumed to be unsteady, quasi-one-dimensional and incompressible, the continuity equation for the illustrated flow system is expressed as follows:

$$Q(t) = -U(x, t)A(x) = a(t)u(t) = -A(h)\frac{dh}{dt} \tag{1}$$

where Q(t) is the volume flow rate of the retardant, U(x,t) is the mean velocity of the fluid in the bucket as a function of time and position on the x-axis. A(h) is the cross-sectional area of the bucket at the free surface of the fluid, that is, at the particular fluid height "h" at any time "t" as the bucket is emptying.

With the volume flow rate Q expressed as a function of time, the retardant level "h" at each instant is determined by the following equation:

$$\int_H^{h(t)} A(x)dx = -\int_0^t Q(t)dt \tag{2}$$

where H is the initial height of the retardant in the bucket (that is, h(0)=H).

The integral form of the quasi-one-dimensional momentum equation for flow through the opening 104 may be written as follows:

$$\frac{d}{dt}\int_0^{h(t)} \rho U dx - (P(0) + \rho U(0)^2) = -\rho g h(t) - \int_0^{h(t)} \rho U^2 \frac{dA}{A} \tag{3}$$

where quantities shown as (0) indicate values directly above the opening 104, P(0) is the hydrodynamic pressure at x=0, and g is the acceleration of gravity.

Using Bernoulli's equation across the discharge area gives the following relation:

$$P(0) + \frac{1}{2}\rho U(0)^2 = \frac{1}{2}\rho u(t)^2 + \rho g h_t \tag{4}$$

where $h_t$ represents the total head loss for the discharge opening assembly (that is, across the valve 106). This total head loss can be expressed as a total resistance coefficient, K, for the discharge opening assembly as follows:

$$h_t = K\frac{u(t)^2}{2g} \tag{5}$$

Those skilled in the art are familiar with the total resistance coefficient expressed in equation (5). For example, *Flow of Fluids through Valves, Fittings and Pipes*, Technical Paper No. 410, Crane Co., New York, N.Y. (1980), incorporated by reference as if set forth in full herein, discusses the determination of K for different kinds of flow systems. It is known that K will be a function of the valve geometry, valve operating position, contraction/expansion geometries upstream and downstream of the valve opening, interior surface roughness, etc. Generally, as taught in the above-identified publication, the resistance coefficient for any particular valve configuration is determined experimentally for the range of flow conditions of interest and then modeled with simple analytical expressions that provide a good match with the experimental data. However, the resistance coefficient can be determined solely analytically for some valves.

In accordance with those principles, it will be understood that K depends on the geometry of the valve 106 and, in some cases, possibly the geometry of the bucket. As the valve 106 varies the size of the opening "a," the value of K will change as well. The most common way of determining the manner in which K will vary as a function of the area "a" is by experiment. For example, the volume flow rate "Q" through the valve will have a theoretical value that can be calculated as a function of the area "a" of the opening provided by the valve. The difference between the actual volume flow rate measured experimentally for different valve positions and the theoretical volume flow rate for each of those valve positions represents the variation of K as the valve opens during a deposition. Accordingly, K can be considered a function of the area "a."

Using equation (4) to eliminate pressure terms, equation (5) to express head loss in terms of the resistance coefficient K, and the continuity equation to express the velocity in terms of flow rate Q, equation (3) may be rewritten as follows:

$$\frac{d}{dt}\left[Q(t)\int_0^{h(t)}\frac{dx}{A(x)}\right]+\frac{Q(t)^2}{2A(h(t))^2}+\frac{(K+1)}{2}\frac{Q(t)^2}{a(t)^2}-gh(t)=0 \tag{6}$$

The term A(h(t)) is used to denote the cross-sectional area A(x) at x=h(t), the free surface of the contents of the bucket.

Equation (6) can be solved for a(t), the rate at which the area "a" of the opening 104 varies in terms of the retardant level and the volume flow rate, as follows:

$$a(t)=\sqrt{\frac{(K+1)}{\frac{2gh(t)}{Q(t)^2}-\frac{1}{A(h(t))^2}-\frac{2}{Q(t)^2}\frac{d}{dt}\left[Q(t)\int_0^{h(t)}\frac{dx}{A(x)}\right]}} \tag{7}$$

One of the significant insights underlying the present invention is the realization that h(t), the retardant level as a function of elapsed time, can be considered a function of the bucket geometry. That is, in accordance with equation (2), h(t) and A(h(t)) in equation (7) can be expressed in terms of the bucket geometry A(x) and the initial height H of the bucket contents, which are known, and the desired volume flow rate profile Q(t), which is set for any given application. Since K is a known function of a(t), as described above, equation (7) demonstrates that it is possible to obtain the prescribed volume flow rate Q(t) solely by using a predetermined valve opening schedule a(t) during a deposition operation. As a result, the present invention eliminates completely the necessity of measuring the instantaneous height or volume of the retardant in the bucket during operation.

In the discussion above, a valve that varies the area of the opening 104 was used above to illustrate the principles underlying the invention. However, implementation of the invention is not limited to the use of such a valve. That is, those skilled in the art will realize from the above discussion that the present invention can be implemented with any flow control device or mechanism capable of varying in accordance with a predetermined schedule the volume flow rate of the bucket contents as they are discharged through the opening. Such a system could vary the flow resistance through the opening, vary the configuration of the flow through the opening, use a valve to vary the area of the opening, or a combination of those approaches, to provide the varying flow characteristics through the opening that are a critical feature of the present invention.

The principles underlying the present invention in accordance with the above discussion can be better understood by considering some actual bucket geometries.

EXAMPLE NO. 1

If the bucket has a constant cross-section having an area $A_0$ and for this example the volume flow rate Q is to be constant during the entire deposition, integration of equation (2) gives the following result:

$$\frac{h(t)}{H}=1-\left(\frac{Q}{HA_0}\right)t \tag{8}$$

It will be appreciated that the value of H (the initial level of retardant in the bucket) can be determined in a variety of ways, discussed in detail later.

For this example, equation (7) gives the following relation for a(t) as controlled by the valve 106:

$$\frac{a(t)}{A_0}=\sqrt{\frac{(K+1)}{\frac{2gHA_0^2}{Q^2}\left[1-\left(\frac{Q}{HA_0}\right)t\right]+1}} \tag{9}$$

Therefore, upon activation, such as by a start switch in the helicopter cockpit, the discharge area jumps to an initial opening to establish the desired volume flow rate. Once that discharge area is reached, t is set to zero and the valve position is modulated to increase the area "a" with the elapsed time in accordance with equation (9).

The exact valve opening schedule a(t) will also depend on the configuration of the valve, since that determines how K varies in accordance with the valve opening schedule.

EXAMPLE NO. 2

If the bucket is the frustum of a right circular cone with a height L, bottom diameter $D_o$ and a top diameter $D_L$, and the volume flow rate Q is constant during the entire deposition, the cross-sectional area is expressed as follows:

$$A(x)=\frac{\pi D_0^2}{4}\left[1+\left(\frac{D_L-D_o}{D_O}\right)\left(\frac{x}{L}\right)\right]^2 \tag{10}$$

Substituting this expression into equation (2), and assuming again that the flow rate Q is to remain constant during deposition, the retardant height as a function of time is given as follows:

$$\frac{h(t)}{H}=\left[\left(1+\frac{D_O}{D_L-D_O}\frac{L}{H}\right)^3-\frac{12}{\pi}\left(\frac{QL^2}{(D_L-D_O)^2H^3}\right)t\right]^{\frac{1}{3}}-\frac{D_O}{D_L-D_O}\frac{L}{H} \tag{11}$$

From equation (7), the variation in discharge area with time is:

$$\frac{a(t)}{A_0}=\sqrt{\frac{(K+1)}{\frac{2gA_0^2h(t)}{Q^2}+\left[\left(\frac{D_L-D_O}{D_O}\right)\frac{h(t)}{L}+1\right]^{-4}}} \tag{12}$$

where $A_0$ is the bucket bottom area ($=\pi D_o/4$) and h(t) is given by equation (11).

As in the previous example, upon activation of the system the discharge area jumps to an initial opening to establish the desired volume flow rate. Once that discharge area is reached, t is set to zero and the area "a" increases with the elapsed time in accordance with equations (11) and (12).

EXAMPLE NO. 3

If the bucket has a height L and an area A that varies exponentially with height such that at the bottom of the bucket (x=0) $A=A_0$, the area can be expressed as follows:

$$A(x)=A_0e^{\frac{x}{L}} \tag{13}$$

Using this expression in equation (2), and again using a constant volume flow rate Q, integration of the equation gives the following expression for the retardant height as a function of time:

$$\frac{h(t)}{H} = \frac{L}{H}\ln\left[e^{\frac{H}{L}} - \frac{Q}{A_0 L}t\right] \tag{14}$$

From equation (7) the required discharge area as a function of time is as follows:

$$\frac{a(t)}{A_0} = \sqrt{\frac{(K+1)}{\frac{2gA_0^2 h(t)}{Q^2} + e^{-\left(\frac{2h(t)}{L}\right)}}} \tag{15}$$

where h(t) is given by equation (14).

As before, upon activation of the system the discharge area jumps to an initial opening to establish the desired volume flow rate. Once that discharge area is reached, t is set to zero and the area "a" increases with the elapsed time in accordance with equations (14) and (15).

Comparison Example

Examples No. 1 to No. 3 represent operation of the present invention. The present Comparison Example demonstrates that the invention maintains the required coverage level over a drop line that is twice as long for the same amount of retardant deposited, as compared to prior art systems in which the valve is opened to an initial value and then maintained at that position. This example is somewhat stylized because it assumes instantaneous valve opening, when in reality the valve takes a finite time to open fully, and the time it takes to open to the desired position will affect the discharge rate during that time.

When the discharge area "a" is set to a constant, equation (1) becomes:

$$Q(t) = u(t)a = -A(h)\frac{dh}{dt} \tag{16}$$

Substituting that expression for Q(t) in equation (6) gives the following nonlinear differential equation:

$$\left[A(h)\int_0^{h(t)}\frac{dx}{A(x)}\right]\frac{d^2h}{dt^2} + \left[\frac{1}{2}\frac{dA(h)}{dh}\int_0^{h(t)}\frac{dx}{A} - \frac{(K+1)}{2}\frac{A(h)^2}{a^2}\right]\left(\frac{dh}{dt}\right)^2 + gh(t) = 0 \tag{17}$$

To simplify matters, this example uses a constant cross-sectional area bucket ($A(x)=A_0$), as in Example No. 1. The acceleration term ($d^2h/dt^2$) in equation (17) can also be neglected because the acceleration of the fluid level as the bucket empties will be very small in relation to the acceleration of gravity g, assuming $a(t)<<A_0$. (The experimental results discussed later validate this assumption.) Those simplifications yield the following differential equation, which can be integrated in closed form:

$$\left[\frac{1}{2} - \frac{(K+1)}{2}\frac{A_0^2}{a^2}\right]\left(\frac{dh}{dt}\right)^2 + gh(t) = 0 \tag{18}$$

Integration yields:

$$h(t) = \left[H^{\frac{1}{2}} - t\left(\sqrt{\frac{g}{2(K+1)\frac{A_0^2}{a^2} - 2}}\right)\right]^2 \tag{19}$$

Substituting this expression for h(t) into equation (16) gives the following expression for the volume flow rate as a function of time:

$$Q(t) = \sqrt{\frac{2g}{\frac{(K+1)}{a^2} - A_0^2}}\left[H^{\frac{1}{2}} - t\left(\sqrt{\frac{g}{2(K+1)\frac{A_0^2}{a^2} - 2}}\right)\right] \tag{20}$$

It will be appreciated from equation (20) that Q(t) is a linear function of t, and that the volume flow rate decreases from a maximum value to zero (when the bucket is empty). The time to empty the bucket, $t_e$, is found by setting Q(t)=0 in equation (20), which yields:

$$t_e = H^{\frac{1}{2}}\sqrt{\frac{1}{g}\left[2(K+1)\frac{A_0^2}{a^2} - 2\right]} \tag{21}$$

Based on the above, the initial volume flow rate (or, equivalently, the discharge area) that will maximize the time the volume flow rate is above a specified value, $Q_r$, for a given initial volume of retardant can be determined. The specified volume flow rate is that rate which is required to achieve the minimum ground coverage for the type of fire being fought. As discussed above, the minimum ground coverage is dependent on the type of fuel (that is, vegetation), and depositing fire retardant at any other concentration wastes time and money and delays extinguishing the fire. The optimum valve configuration for this Comparison Example corresponds to the maximum line length for which retardant deposition is equal to or exceeds the specified volume flow rate for a given initial volume of retardant.

Figure 3:
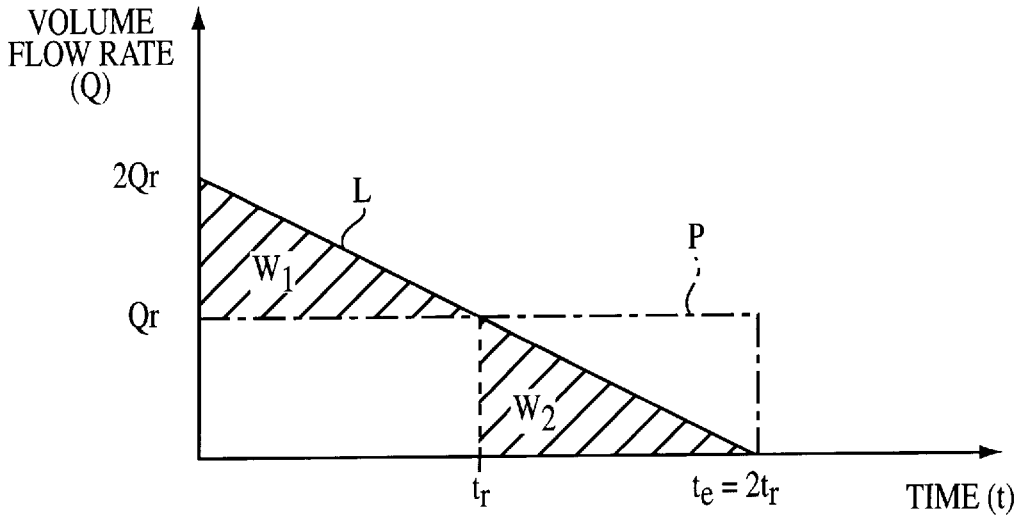
FIG. 3 plots the fire retardant volume flow rate provided by the present invention and the volume flow rate provided by the prior art technique having a variable volume flow rate.

The amount of time and retardant wasted by simply opening the valve and dumping retardant is illustrated graphically in FIG. 3. The volume flow rate for this Comparison Example is linear and is depicted by the solid line L. Since the volume flow rate varies linearly, as seen by equation (20), the volume flow rate is above the required value $Q_r$ for the first half of the deposition ($t \leqq t_r$) and below the required value for the second half ($t_r < t \leqq 2t_r$).

As a result, only half the area is covered by at least the required amount of retardant. This means that more depositions must be performed to provide the equivalent fire fighting effectiveness. FIG. 3 illustrates this result by the shaded areas $W_1$ and $W_2$. $W_1$ is the amount of retardant wasted while the volume flow rate Q is higher than the desired volume flow rate $Q_r$ during the first half of the deposition time $t_e$. $W_2$ is the amount of retardant deposited during the second half of the deposition time. Since it is deposited at a flow rate that is less than the desired volume flow rate $Q_r$, another drop must be conducted over this portion of the drop line.

Using the present invention according to the embodiment described in Example 1 above, and setting the volume flow rate in equation (9) to $Q_r$, gives an effective deposition time twice that in the Comparison Example. Accordingly, for the same aircraft ground speed, the present invention provides a deposition line twice as long as can be obtained when the valve is simply opened as in the Comparison Example.

Accordingly, FIG. 3, in which the volume flow rate of the present invention is represented by the phantom line P, illustrates graphically how the present invention improves over the prior art. That is, substantially the same amount of retardant is deposited over the entire drop line at the desired volume flow rate. Thus, all of the available retardant for each drop is used to fight the fire, thus eliminating the inefficiencies in the prior art approach described in the Comparison Example.

Figure 4:
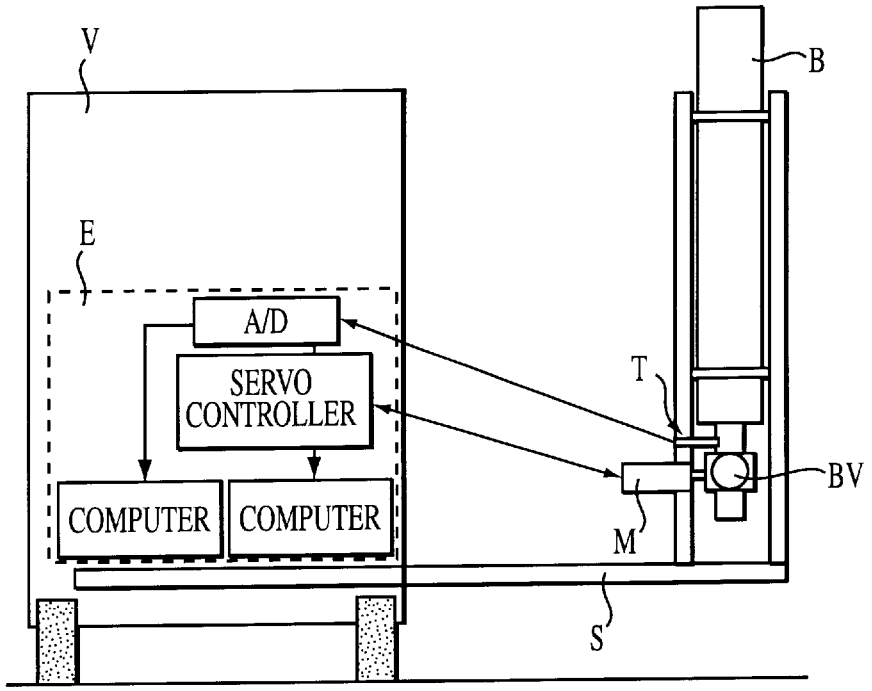
FIG. 4 is a schematic of a test set-up used to validate the principles underlying the present invention.

Several experiments have been conducted to verify that the above theoretical principles underlying the invention accurately predict the performance of a bucket operated in accordance with those principles. FIG. 4 illustrates the test rig used to in these experiments.

A motor vehicle, in this case a van V, had a bucket B attached to its side by an outrigger structure S mounted on the van. The bucket was a circular cylinder, the performance of which should be controllable in accordance with the above discussion accompanying Example 1 and the Comparison Example. The contents of the bucket B empty from the bottom thereof through a ball valve BV. The schedule for K as a function of valve position was determined experimentally, in accordance with the principles discussed above.

During deposition, the valve position was controlled by an electric motor M. For purposes of the experiment, the motor was controlled by electronic components E in the van V, but as will be seen later, one of the advantages of the invention is that its implementation does not require complex, fragile electronic components. The initial height of the bucket contents was determined by a pressure transducer T. As is also discussed later, the present invention can be implemented without using a pressure transducer, but one was used in these experiments to monitor system performance. The electronic components included a first computer programmed with the appropriate equations discussed above to provide open-loop control of the valve in accordance with the present invention, and a second computer to monitor system performance.

In the experiments, the van V was driven along a straight line at different speeds. Containers were placed at intervals under the path of the bucket to catch the contents of the bucket as they were deposited while the van was moving at a constant speed. The amount of liquid in each container was measured at the end of each run.

Figure 5:
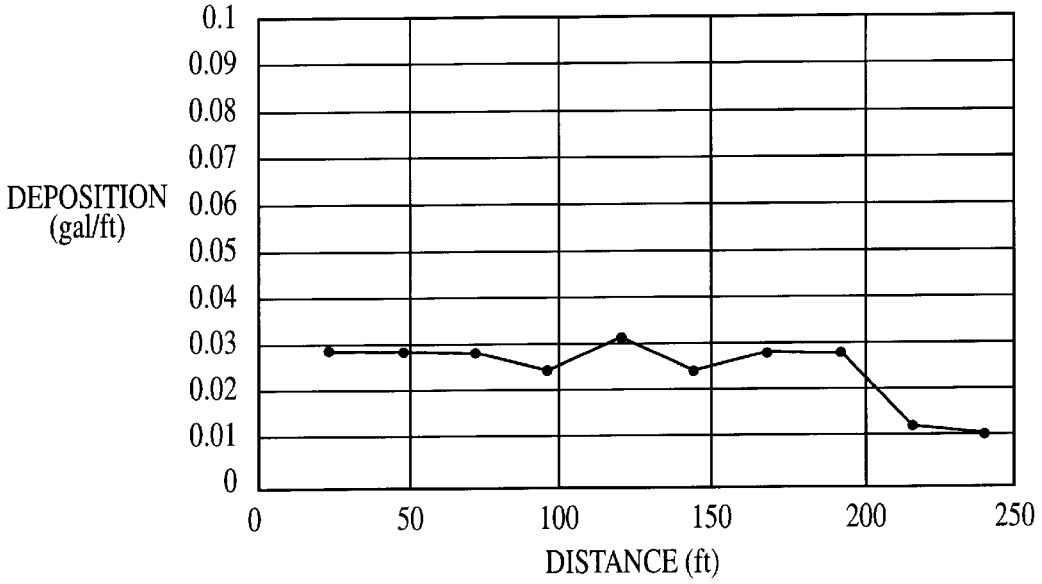
FIG. 5 plots the results of a first experiment using the test set-up in FIG. 4 to validate the principles underlying the present invention.
Figure 6:
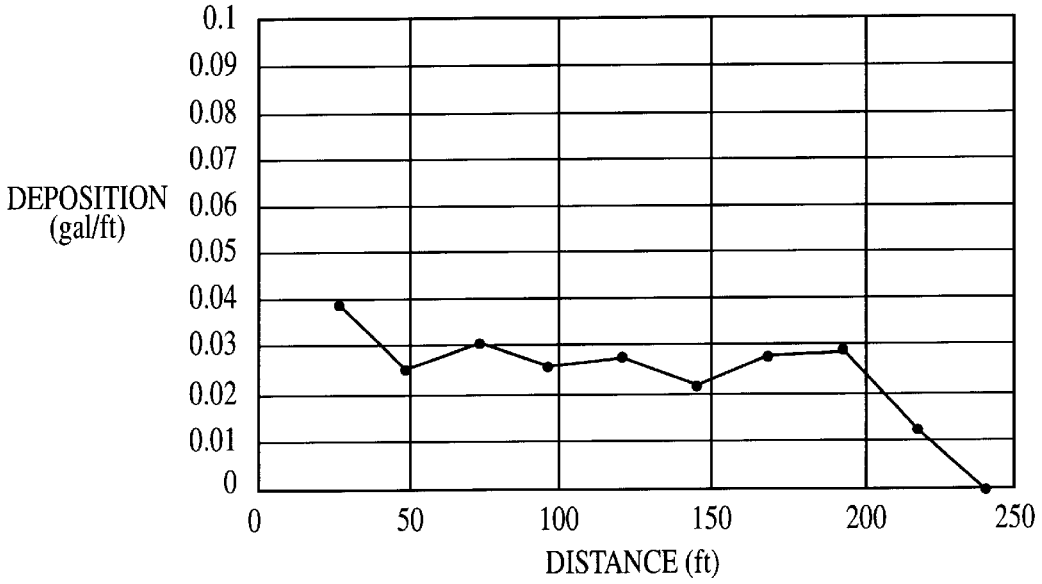
FIG. 6 plots the results of a second experiment using the test set-up in FIG. 4 to validate the principles underlying the present invention.

FIG. 5 illustrates the results of one run in which the van was driven at 20 miles per hour and the target volume flow rate Q was set to discharge the bucket contents at a constant 0.025 gallons per linear foot. (Actual applications of the invention usually refer to coverage per square foot, which will correspond to a volume flow rate along a line as measured in these experiments.) FIG. 6 illustrates the results of another run in which the van was driven at 10 miles per hour with the same target volume flow rate. In both runs, the valve position was varied in accordance with the present invention, that is, using the equations set forth in Example 1 above. These figures illustrate that the deposition rate was maintained substantially constant at the target rate throughout most of the length required to empty the bucket.

Figure 7:
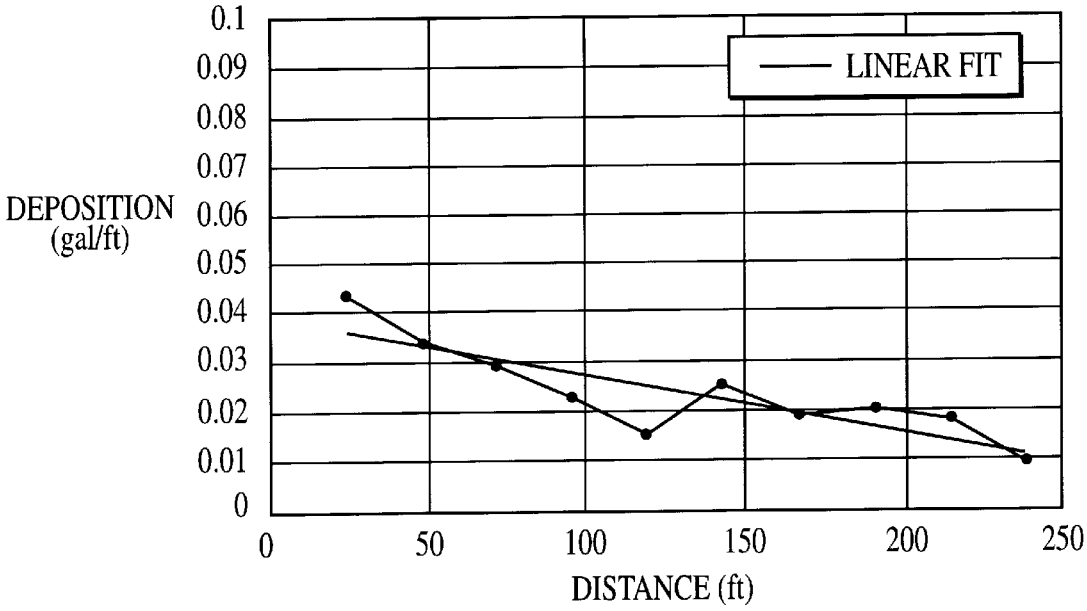
FIG. 7 PRIOR ART
FIG. 7 plots the results of an experiment using the test set-up in FIG. 4 to deposit a liquid in accordance with the prior art technique plotted in FIG. 3.

FIG. 7 illustrates the results of a run in which the valve was opened to a constant value at the beginning of a run in which the van was driven at 20 miles per hour. Using the principles discussed above in connection with the Comparison Example, the valve position was set to provide the maximum line length over which the deposition rate would be at least 0.025 gallons per foot. That is, this run enables direct comparison with the results of the run illustrated in FIG. 5.

The heavier, straight line in FIG. 7 superimposes on the plotted data the linear relationship that best fits the data points that resulted from this run. Comparing that line with the data plotted in FIG. 5, it will be appreciated that the desired deposition rate of 0.025 gallons per foot was achieved for about one-half of the total run length, as predicted by the equations that express the principles underlying the invention and plotted in FIG. 3.

Those skilled in the art will appreciate the many significant implications of the above discussion of the present invention. For example, the invention is not limited to depositing material at a fixed volume flow rate. As equation (7) shows, any desired volume flow rate profile Q(t) can be achieved with an appropriate valve opening schedule a(t). That is, the volume flow rate can be varied during the deposition according to any desired function Q(t).

Because the present invention uses open-loop control, which varies the volume flow rate through the bucket opening in terms of a predetermined schedule solely on parameters that are known before a deposition commences, and does not even require measuring the elapsed time from the beginning of a deposition when implemented with a mechanical system, it can be implemented in many ways that provide a less expensive, more robust fire-fighting system than the closed-loop control of the prior art.

One parameter that controls the volume flow rate schedule is the initial height "H" of the bucket's contents. Accordingly, one way the invention can be implemented is with a bucket having a plurality of apertures in its sides that determine the level to which the bucket is filled when it is immersed in a body of water or a tank of fire-retardant. This type of bucket is disclosed in U.S. Pat. No. 3,710,686. Alternatively, the bucket can be filled using a bucket- or aircraft-mounted pump which is controlled by a float switch that terminates power to the pump when a certain retardant level in the bucket is reached. Those skilled in the art will appreciate that these are merely examples, and other means of determining the initial level of the bucket's contents can be used within the scope of the present invention. One example of an alternate technique is a sensor in the helicopter that supplies a signal indicative of the bucket's weight.

The other parameters that determine the schedule according to which the flow through the opening is controlled are functions solely of the configuration of mechanical parts of the bucket. That is, the bucket geometry, denoted as A(x) in the equations above, is of course known for any particular bucket. If a mechanical valve is used, the variation in K as the valve varies the size of the opening is likewise known or can be determined experimentally or analytically. These parameters only need to be determined once for a given bucket/valve combination, after which the appropriate valve opening schedule a(t) required to deposit the bucket contents at the desired volume flow rate Q(t) can be determined in accordance with the invention.

It is also possible with the present invention to deposit a partial line of fire retardant. Consider first that the bucket geometry, namely, A(x), is known. Therefore, the height of the bucket contents "h" when the desired amount of the bucket's contents has been deposited is also known. Accordingly, the value of the terms h(t) and A(h(t)) in equation (7) when the deposition line reaches the desired length can be calculated for a given bucket. Those skilled in the art will readily appreciate that there are various ways in which that information can be used to deposit a desired line of material. For example, a mechanical system with a built-in valve opening schedule can close the valve when it reaches the value of a(t) corresponding to the height "h" for the desired line length, and then reactivated automatically or by pilot control when the remaining contents of the bucket are to be deposited.

In an alternative approach a timer can be used to shut off the valve when the time elapsed from the beginning of a deposition reaches a value that leaves the appropriate amount of material in the bucket. Such a system, properly calibrated, would allow the pilot to set the line length using a cockpit control.

Thus, the present invention provides a technique for ensuring that the volume flow rate of material dropped from an aircraft-mounted bucket is deposited according to a desired profile, without monitoring the state of the bucket contents as the drop proceeds. In a particularly advantageous application of the invention, namely depositing fire-retardant material, that volume flow rate is typically a constant in order to deposit a required amount of retardant over an entire drop line. However, it need not be constant if circumstances require otherwise.

As the above test results show, the present invention results in a deposition that for all practical purposes achieves the ideal of providing a desired volume flow rate profile. It does so without the closed-loop control used in prior art fire-fighting systems in which complex, fragile and expensive control circuitry is needed to continuously monitor the level of the bucket contents and adjust the position of a valve accordingly.

Of course, the open-loop control of the present invention does not permit the volume flow rate to be adjusted during a drop to account for random aircraft speed variations, in the manner of certain prior art systems such as that disclosed in U.S. Pat. No. 5,320,185. However, that is not particularly significant in the environment in which these systems are used. In the first place, it is the aircraft's ground speed that must be accounted for, and that requires even more expensive instrumentation, such as a global positioning system, to provide the necessary ground speed signal to the control system. But more significant than that is the fact that a fire-retardant deposition typically only takes between about three and 20 seconds. As a practical matter, the physics of flight and the mass of the aircraft maintain aircraft speed substantially constant during such a short time. Moreover, small variations in ground speed will not significantly change the deposition rate, considering the many factors that determine the actual deposition rate, such as air turbulence between the aircraft and the ground.

Regarding specific structure for implementing the invention, the valve 106 will most advantageously be capable of opening to an initial position as quickly as possible. Such a valve can be provided by configuring it so that it does not require moving large amounts of the retardant in order to change the size of the deposition opening.

Figure 8:
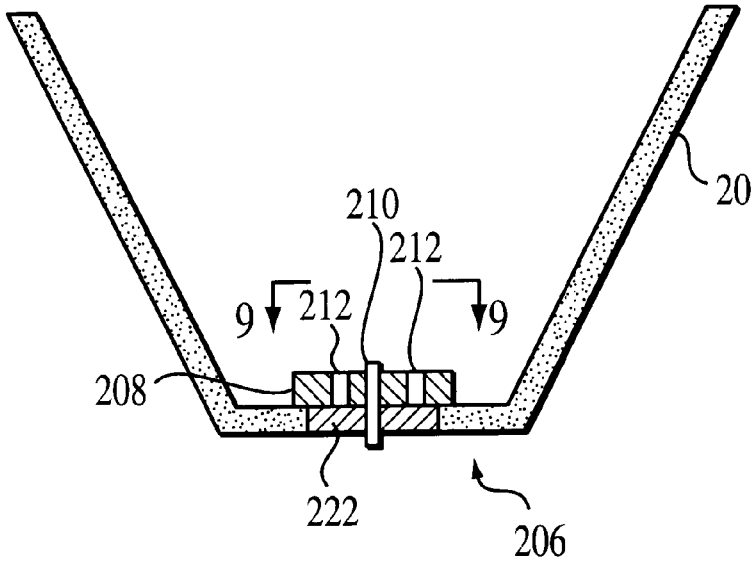
FIG. 8 is a schematic cross-section of a bucket having a retardant valve in accordance with an embodiment of the present invention.
Figure 9:
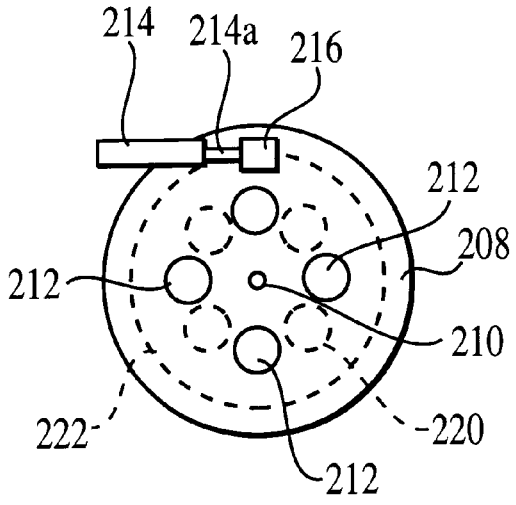
FIG. 9 is a view taken at line 9—9 of FIG. 8.

FIGS. 8 and 9 schematically illustrate a fast-acting valve 206 in accordance with one embodiment of the invention. The valve 206 includes a top plate 208 that rotates on a shaft 210. The top plate 208 has several circular openings 212, the centers of which are arranged on a circle centered on the shaft 210. An electrically driven ball-and-screw actuator 214 has one end anchored to the bucket 20 and the other end to a pivot 216 on the top plate 208. The actuator arm 214*a* thus lengthens and shortens in accordance with the energization of a conventional submersible DC motor (not shown). As the actuator arm changes length, it rotates the top plate 206, and the openings 212 are brought more or less into registration with corresponding openings 220 in a lower plate 222 fixed in the bottom of the bucket. In this manner, the opening area "a" of the valve is controlled.

One advantage of the valve 206 is that the contents of the bucket exert very little force impeding the operation of the valve as it opens and closes. Thus, it will respond quickly to the actuation force applied to it by the actuator.

This embodiment of the invention, using a mechanical valve and actuator, can be implemented without expensive, fragile electronic controls. That is, the schedule for opening the valve, determined using the principles discussed above, can be set by the configuration of the valve actuating mechanism. For example, the ball-and-screw actuator 214 can have a variable-pitch configuration that provides the appropriate valve opening schedule a(t) for a particular volume flow rate Q(t).

Generally, it is not necessary to alter the schedule for a given fire because the conditions affecting the deposition rate on the ground, such as the prevailing wind speed and altitude at which the retardant is dropped, remain the same for the duration of the fire. Although it is not likely that the valve opening schedule will have to be changed while fighting a particular fire, such a change can be effected by substituting another ball-and-screw actuator. By appropriately designing the connection of the actuator to the valve and bucket, such a change can be made in a matter of a few minutes at a staging site near the fire.

Figure 10:
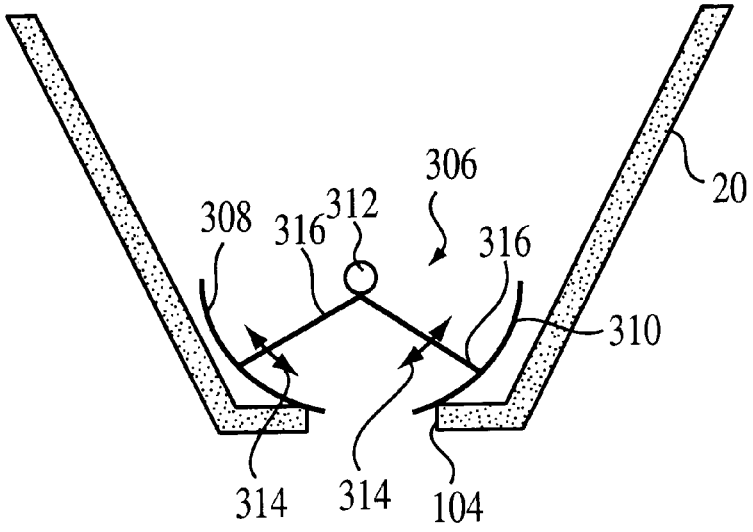
FIG. 10 is a schematic cross-section of a bucket having a retardant valve in accordance with another embodiment of the present invention.

FIG. 10 schematically illustrates another embodiment of a valve suitable for use with the present invention. The valve 306 in FIG. 10 has a clamshell configuration, in which two cylindrical flaps 308 and 310 are hinged at their axes of rotation to a shaft 312. The valve position is adjusted by moving the flaps about the shaft in the direction of the arrows 314. The valve position can be controlled by an electrically driven ball-and-screw actuator (not shown), as discussed above. The actuator can be mounted between the arms 316 attaching the flaps to the shaft 312. As with the valve shown in FIGS. 8 and 9, the valve 306 opens and closes while exerting almost no force against the contents of the bucket.

Figure 11:
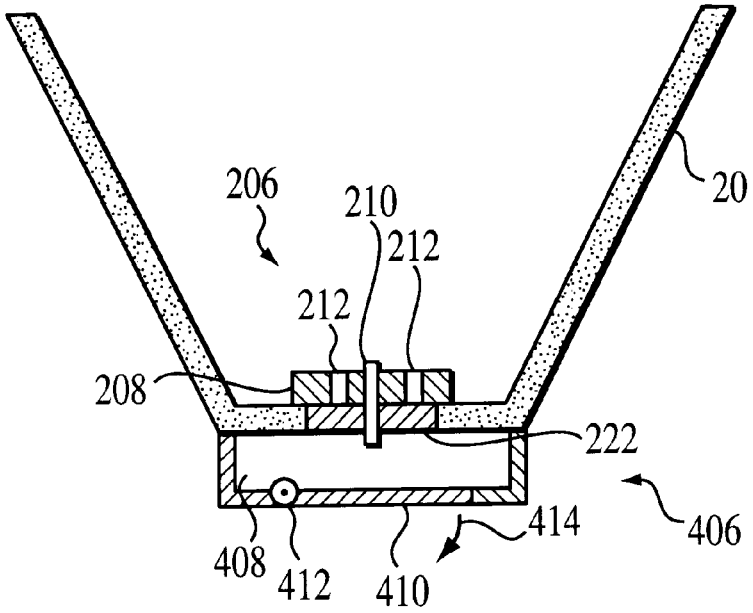
FIG. 11 is a schematic cross-section of a bucket having a retardant valve in accordance with still another embodiment of the present invention.

In addition to the single valve configurations shown in FIGS. 8 to 10, the present invention can also advantageously be used with a double valve arrangement 406 as shown in FIG. 11.

The double valve 406 includes a first, upper valve is used to control the volume flow rate from the bucket pursuant to a predetermined schedule, in accordance with the present invention. In FIG. 11 the upper valve is identical to the valve 206 described in connection with FIGS. 8 and 9. A second, lower valve includes an auxiliary chamber 408 with a trap door 410 mounted to the auxiliary chamber 408 by a hinge 412. The trap door is secured in its closed position as shown in FIG. 11 by a latch (not shown) that can be released by the pilot. When the latch is released, the trap door 410 swings downwardly in the direction of the arrow 414 under the influence of gravity to open the chamber 408.

In operation, the first valve 206 is set to the initial flow control position as the aircraft nears the drop zone. To initiate deposition of the bucket contents, any suitable control, either automatic or pilot-operated, releases the latch holding the trap door 410 closed. The deposition thus begins at the proper volume flow rate without the delay associated with moving a single valve into the initial position called for by the volume flow rate control schedule. Although this valve arrangement is more complex and because of its weight reduces somewhat the amount of retardant that can be carried to the fire, it does provide for more accurate volume flow rate at the onset of deposition.

It is also within the scope of the invention to provide multiple valves and control the number that are opened to vary the size of the opening in accordance with the desired schedule. In addition, while the above discussion refers to the use of an electric actuator for the valves shown, it will be appreciated that a hydraulic or mechanical actuator may be used as well, or a combination electric/hydraulic/mechanical actuator.

The initial height of the retardant in the bucket can be measured in numerous ways other than those discussed above. For example, in addition to sensing the weight of the bucket, a signal could be provided to a control system on board the aircraft by suitable telemetry, or by a cable connection between the bucket and the aircraft. Ultrasonic gauges can also be used to measure the initial retardant height.

Additional operational flexibility can be achieved by using electronic control to provide the valve opening schedule. Such a control system could incorporate a programmable logic controller to perform some of the functions discussed above. The invention can be implemented using such a controller in many ways. For example, a bucket could include a signal cable associated with it that the user connects to a signal cable on the aircraft when the bucket support cables are attached to the aircraft. The bucket signal cable would provide signals relating to the type of bucket (to identify the bucket geometry) and the initial retardant height.

Alternatively, the controller could be preprogrammed so that the pilot merely has to input the type of bucket (say, the brand name and model), and the controller uses the proper algorithm reflecting the bucket geometry (see, for example, equations (9), (12) and (15)) and the variation in K as the valve position changes. In addition, the controller could be programmed to allow the pilot to input the desired airspeed over the drop zone, the desired coverage rate, the prevailing wind velocity, or other parameters, after which the controller calculates the proper algorithm to provide the desired flow rate to achieve the desired volume flow rate for those conditions.

Then, when the pilot approaches the drop zone he would simply push a start button and maintain his speed as constant as possible during the drop. The valve opening could be adjusted for the initial aircraft speed, or the controller could provide a read-out as to the speed the pilot should maintain over the drop zone.

The invention enables extremely accurate and versatile operation with very simple electronic control, thus avoiding the drawbacks of the prior art closed-loop control. For example, the pilot might have a preprinted table of the proper volume flow rate control setting depending on factors such as the type of fire being fought, the prevailing wind velocity, and the speed at which the drop is to be performed. The table would have a number or letter that the pilot could dial into a controller on the aircraft to set the volume flow rate schedule to obtain the required coverage. More such factors can be included if a computer is used to calculate the required volume flow rate schedule.

It will be clear to those skilled in the art that the invention is not limited to a bucket that is suspended by cables from a helicopter. Any suitable structure for securing the bucket to an aircraft whereby the bucket's contents can be deposited from the opening in the bucket is of course within the scope of the present invention.

While preferred embodiments of the invention have been depicted and described, it will be understood that various changes and modifications can be made other than those specifically mentioned above without departing from the spirit and scope of the invention, which is defined solely by the claims that follow.

What is claimed is:

1. A bucket for depositing a flowable material, the bucket comprising:

means for attaching the bucket to an aircraft;

an opening in the bucket for discharging the material; and a flow controller for varying the characteristics of the flow through said opening to discharge the material at a volume flow rate as a desired function of time while the aircraft flies over a drop zone, wherein said flow controller varies the characteristics of the flow through said opening as a set function of time determined prior to initiation of discharge.

2. A bucket as in claim 1, wherein said flow controller varies a resistance of the flow through said opening to vary the volume flow rate therethrough.

3. A bucket as in claim 1, wherein said flow controller varies a configuration of the flow through said opening to vary the volume flow rate therethrough.

4. A bucket as in claim 1, wherein said flow controller varies the area of said opening to vary the volume flow rate therethrough.

5. A bucket having a predetermined configuration for depositing a flowable material, the bucket comprising:

means for attaching the bucket to an aircraft;

an opening in the bucket for discharging the material; and a flow controller for varying the characteristics of the flow through said opening to discharge the material at a volume flow rate as a desired function of time while the aircraft flies over a drop zone, wherein said flow controller varies the flow characteristics through said opening as a set function of time determined prior to initiation of discharge in accordance with the configuration of the bucket and the amount of the material in the bucket before discharge begins.

6. A bucket as in claim 5, wherein said flow controller varies a flow resistance through said opening to vary the flow characteristics thereof.

7. A bucket as in claim 5, wherein said flow controller varies a configuration of the flow through said opening to vary the flow characteristics thereof.

8. A bucket as in claim 5, wherein said flow controller comprises:

a valve for varying the area of said opening; and a mechanism for controlling said valve to vary the area of said opening in accordance with a set function of time determined prior to initiation of discharge in accordance with the configuration of the bucket, the flow characteristics of said opening as said valve varies the area thereof, and the amount of the material in the bucket before discharge begins.

9. A bucket as in claim 8, wherein said mechanism includes a valve actuator having a configuration determining the set function of time.

10. A bucket as in claim 8, wherein the flow characteristics of said opening as said valve varies the area thereof are determined experimentally.

11. A bucket as in claim 8, wherein the flow characteristics of said opening as said valve varies the area thereof are determined analytically.

12. A bucket as in claim 5, wherein the volume flow rate is substantially constant during the deposition.

13. A bucket as in claim 5, wherein said means for attaching the bucket to an aircraft includes cables for suspending the bucket from a helicopter to deposit fire-retardant material, and said opening is located proximate to the bottom of the bucket when it is suspended from the helicopter.

14. A bucket as in claim 13, wherein said flow controller comprises:

a valve for varying the area of said opening substantially without moving against a hydrostatic force generated on said valve by the fire-retardant material in the bucket; and a mechanism for controlling said valve to vary the area of said opening in accordance with a set function of time determined prior to initiation of discharge in accordance with the configuration of the bucket, the flow characteristics of said opening as said valve varies the area thereof, and the amount of the material in the bucket before discharge begins.

15. A bucket as in claim 14, wherein said valve comprises:

a fixed first plate member having a plurality of first holes therethrough;

a second plate having a plurality of second holes therethrough, said second plate being mounted to said first plate for movement relative thereto for bringing said first and second holes into varying degrees of registration to form said opening; and a valve actuator for moving said second plate relative to said first plate to vary the area of said opening.

16. A bucket as in claim 15, wherein said valve actuator has a configuration for controlling the position of said second plate to vary the area of said opening in accordance with the set function of time.

17. A bucket as in claim 14, wherein said valve comprises a clamshell with two hinged plates forming said opening therebetween and a valve actuator for moving said plates relative to each other to vary the area of said opening.

18. A bucket as in claim 13, wherein said flow controller comprises:

a first valve for varying the area of said opening;

a mechanism for controlling said first valve to vary the area of said opening in accordance with a set function of time determined prior to initiation of discharge in accordance with the configuration of the bucket, the flow characteristics of said opening as said valve varies the area thereof, and the amount of the material in the bucket before discharge begins;

a second valve for preventing discharge of the material through said opening; and means for moving said first valve to set the area of said opening required at the initiation of discharge and thereafter rapidly opening said second valve.

19. A bucket as in claim 13, further comprising means for filling the bucket with a predetermined amount of fire-retardant material.

20. A bucket as in claim 13, further comprising means for detecting the amount of fire-retardant material in the bucket.

21. A bucket as in claim 13, further comprising control circuitry for determining the set function of time further in accordance with a ground coverage to be achieved by the material and the desired speed of the aircraft over the drop zone.

22. A bucket as in claim 13, further comprising a sensor for detecting the height of the material above said opening before a deposition is initiated.

23. A method for depositing a flowable material at a volume flow rate as a desired function of time, the method comprising the steps of:

providing a bucket having an opening for discharging the material;

attaching said bucket to an aircraft with said opening disposed proximate to the bottom of said bucket;

filling said bucket with an amount of the material;

flying over a drop zone with said bucket attached to the aircraft; and depositing the material on the drop zone at the desired volume flow rate by controlling the characteristics of the flow through said opening as a set function of time determined prior to initiation of discharge.

24. A method as in claim 23, wherein a resistance of the flow through said opening is controlled to vary the volume flow rate therethrough.

25. A method as in claim 23, wherein a configuration of the flow through said opening is controlled to vary the volume flow rate therethrough.

26. A method as in claim 23, wherein the area of said opening is controlled to vary the volume flow rate therethrough.

27. A method for depositing a flowable material at a volume flow rate as a desired function of time, the method comprising the steps of:

providing a bucket with a predetermined configuration and an opening in the bucket for discharging the material;

suspending said bucket from an aircraft with said opening disposed proximate to the bottom of said bucket;

filling said bucket with an amount of the material;

flying over a drop zone with said bucket suspended from the aircraft; and depositing the material on the drop zone at the desired volume flow rate by varying the characteristics of the flow through said opening as a set function of time determined prior to initiation of discharge in accordance with the configuration of said bucket and the amount of the material in said bucket before discharge begins.

28. A method as in claim 27, wherein a flow resistance through said opening is controlled to vary the flow characteristics therethrough.

29. A method as in claim 27, wherein a configuration of the flow through said opening is controlled to vary the flow characteristics therethrough.

30. A method as in claim 27, wherein the set function of time is determined further in accordance with a ground coverage to be achieved by the material and the desired speed of the aircraft over the drop zone.

31. A method for depositing a flowable fire-retardant material on a fire at a volume flow rate as a desired function of time while the aircraft flies over a drop zone, the method comprising the steps of:

providing a bucket with a predetermined configuration and a valve for varying the area of an opening in said bucket through which the material is discharged;

suspending said bucket from an aircraft with said opening disposed proximate to the bottom of said bucket;

filling said bucket with an amount of the material;

flying over a drop zone with said bucket suspended from the aircraft;

opening said valve to an initial position to begin discharging at an initial value of the desired volume flow rate; and thereafter controlling said valve to vary the area of said opening in accordance with a set function of time determined prior to initiation of discharge in accordance with the configuration of said bucket, the flow characteristics of said opening as said valve varies the area thereof, and the amount of the material in said bucket before discharge begins.

32. A method as in claim 31, further comprising the step of terminating discharge by closing said valve when there is a predetermined amount of material remaining in said bucket.

33. A method as in claim 32, wherein discharge of material is terminated when the set function of time specifies that the predetermined amount of material remains in said bucket.

* * * * *